US006286610B1

(12) United States Patent
Berger et al.

(10) Patent No.: US 6,286,610 B1
(45) Date of Patent: Sep. 11, 2001

(54) PERCUSSION AND/OR DRILL HAMMER WITH OSCILLATION DAMPING

(75) Inventors: Rudolf Berger; Thomas Maurer, both of Munich (DE)

(73) Assignee: Wacker-Werke GmbH & Co. KG, Munich (DE)

( * ) Notice: Subject to any disclaimer, the term of this patent is extended or adjusted under 35 U.S.C. 154(b) by 0 days.

(21) Appl. No.: 09/462,851

(22) PCT Filed: Jun. 24, 1998

(86) PCT No.: PCT/EP98/03870

§ 371 Date: Jan. 13, 2000

§ 102(e) Date: Jan. 13, 2000

(87) PCT Pub. No.: WO99/03647

PCT Pub. Date: Jan. 28, 1999

(30) Foreign Application Priority Data

Jul. 15, 1997 (DE) ..... 197 30 356

(51) Int. Cl.[7] ..... B25F 5/00

(52) U.S. Cl. ..... 173/162.1; 173/162.2

(58) Field of Search ..... 173/211, 162.1, 173/162.2, 210; 267/137, 140.5, 141

(56) References Cited

U.S. PATENT DOCUMENTS

| | | | | |
|---|---|---|---|---|
| 3,845,557 | * | 11/1974 | Bailey | 173/162.2 |
| 3,939,923 | * | 2/1976 | Aldag et al. | 173/162.1 |
| 4,010,544 | * | 3/1977 | Siman | 173/162.1 |
| 4,385,665 | * | 5/1983 | Knoll | 173/162.1 |
| 4,402,383 | * | 9/1983 | Bailey | 173/162.1 |
| 4,673,043 | * | 6/1987 | Greppmair | 173/162.2 |
| 4,771,833 | | 9/1988 | Honsa . | |
| 4,827,147 | | 5/1989 | Mizushima . | |
| 4,905,772 | * | 3/1990 | Honsa et al. | 173/162.1 |
| 5,025,870 | * | 6/1991 | Gantner | 173/162.1 |
| 5,027,910 | | 7/1991 | Honsa et al. . | |
| 5,273,120 | * | 12/1993 | Chang | 173/162.2 |
| 5,692,574 | * | 12/1997 | Terada | 173/162.2 |

FOREIGN PATENT DOCUMENTS

| | | | | |
|---|---|---|---|---|
| 2359708 | * | 6/1974 | (DE) | 173/162.2 |
| 2913330C2 | | 6/1982 | (DE) . | |
| 34 05 922 C2 | | 8/1985 | (DE) . | |
| 40 00 861 C3 | | 7/1991 | (DE) . | |
| 42 11 316 A1 | | 10/1993 | (DE) . | |
| 43 06 588 A1 | | 1/1994 | (DE) . | |
| 2154497 | * | 9/1985 | (GB) | 173/162.1 |
| 381743 | * | 11/1977 | (SU) | 173/162.2 |
| 933446 | * | 6/1982 | (SU) | 173/162.1 |

* cited by examiner

*Primary Examiner*—Scott A. Smith
(74) *Attorney, Agent, or Firm*—Boyle Fredrickson Newholm Stein & Gratz SC

(57) ABSTRACT

The inventive percussion and/or drill hammer (10) consists essentially of a hammer housing (12) which surrounds a rotor for a percussive tool (11), including the drive mechanism and the holding element, and an outer shell (14) which encompasses the hammer housing (12) at a distance. Said outer shell (14) is connected elastically to the hammer housing (12) at selected coupling points and is connected to a first handle (16) at the end facing away from percussive tool (11) in the direction of impact of said percussive tool (11). The outer shell (14) extends as far as or at least almost as far as the percussive tool (11) where it is provided or can be provided with a second handle (17), said percussive tool projecting out of the hammer housing (12).

24 Claims, 1 Drawing Sheet

16
20
26
18c
22
18b
18a
14
10
II
II
12
17
15
11

12
24
22
20
26
14

PERCUSSION AND/OR DRILL HAMMER WITH OSCILLATION DAMPING

BACKGROUND OF THE INVENTION

1. Field of the Invention

The invention relates to a percussion hammer and/or hammer drill, having a hammer casing which surrounds a percussion mechanism together with drive and holder for a percussion tool and is surrounded, at a distance, by an outer shell which, at selected coupling points, is elastically connected to the hammer casing and at whose end which is remote from the tool in the direction of impact thereof there is a handle.

A tool of this nature is known from DE 40 00 861 C2. In this tool, the vibrations acting on the hand or arm of the person guiding the tool are only reduced to an insufficient extent. Moreover, the spring or damping action has not yet been made sufficiently adaptable to different operating conditions in the prior art.

2. Description of the Related Art

In the design which is known from DE 40 00 861 C2—in the arrangement which is known for tools of this nature—a transmission casing and a motor casing which is connected to the transmission casing follow one after the other in the direction of impact of the tool, starting from the driven tool. These two elements are referred to above for short as the hammer casing. The vibrations which are emitted from this hammer casing are damped with respect to the handle located on the outer shell at the end which is remote from the tool by means of the elastic support between the hammer casing and the outer shell.

To provide reliable guidance for such tools, it is known, and highly advantageous, if a second handle is arranged as close as possible to the percussion tool which projects out of the transmission casing, in order for it to be possible to hold the tool with both hands and to obtain a guide length which is as long as possible.

In the tool which is known from DE 40 00 861 C2, the outer shell does not surround the entire hammer casing, but rather only the section which is formed by the motor casing. This document does not show a second handle. If it were desired to provide such a second handle, it would have to be connected to the transmission casing, and consequently all the vibrations which, as a result of the hammer casing being separate from the outer shell surrounding the motor casing only reach the first handle in damped form, would be transmitted to this second handle without any damping. Not only is this unpleasant when handling the tool, it also impairs reliable guidance of the tool.

DE 34 05 922 A1 has disclosed a handheld power tool in which a hammer casing, which has a handle, surrounds a tool drive, a percussion mechanism and a holder for a percussion tool. The percussion mechanism is secured in the hammer casing via damping elements, while the drive, which is formed by an electric motor, is rigidly connected to the hammer casing. The vibrations which are produced when the electric motor is operating are therefore transmitted to the handle without any damping.

OBJECTS AND SUMMARY OF THE INVENTION

The invention is therefore based on the object of designing a percussion hammer and/or hammer drill of the type mentioned at the outset in such a way that it can be held with both hands at the same time, and in such a manner that the vibrations which emanate from the hammer casing only reach the handles, which are used to hold and guide the hammer and are assigned to both hands, in highly damped form, so that the vibrations acting on the hands and arms are reduced as far as possible, and guidance of the hammer is improved.

It is also intended for it to be possible to design spring or damping elements which are arranged in the area of the connection between the hammer casing and the outer shell in such a way that they have spring characteristics which can be set as desired in six degrees of freedom, and furthermore the forces acting on these connecting areas are to be kept as low as possible.

In a percussion hammer and/or hammer drill of the type described, the solution consists in the fact that the outer shell extends as far as or at least almost as far as the percussion-tool holder which projects out of the hammer casing, where it is or can be provided with a second handle, and preferably the coupling points on the two sides of the hammer casing are arranged symmetrically with respect to the longitudinal center plane of the hammer or drill.

The arrangement according to the invention not only provides vibration damping for the second handle, but also, due to the arrangement of both handles on a single component which is elastically connected to the hammer casing, provides synchronous damping of both handles, i.e. there is no relative movement between the two handles, thus making handling and guidance of the tool comfortable and safe.

If the outer shell, on both sides of the hammer casing, is connected to the hammer casing at in each case two coupling points, the line of action of the tool preferably intersects a plane which includes the coupling points, which number four in total.

According to a particularly advantageous configuration, the outer shell, on both sides of the hammer casing, is connected to the hammer casing at in each case three coupling points, which do not lie on a common straight line.

A further highly advantageous configuration consists in the fact that the connections at the individual coupling points are produced by means of elastomeric elements, and preferably a body made from elastomeric material is attached to the hammer casing at each coupling point, which body has a hole which is at least substantially perpendicular to the longitudinal center plane of the hammer casing and in which a bolt, which projects inward from the outer shell, engages.

According to a further advantageous configuration, the bodies made from elastomeric material are each held in a sleeve on the hammer casing.

According to a further advantageous variant, the outer shell is made from plastic, thus providing, together with the arrangement of the elastomeric elements, a particularly effective electrical insulation.

Another advantageous configuration consists in the fact that the elastomeric bodies have different resilient properties in different directions, in which case the bodies of elastomeric material preferably have different dimensions in two diametral directions which intersect one another in the axis of the hole, thus making it possible to achieve different spring or damping actions for example in the direction of vibration of the tool and transversely with respect to this direction.

The geometry of the bodies and the arrangement of the coupling points with respect to one another allow the spring characteristics to be set as desired in six degrees of freedom, allowing even very long spring excursions.

Preferably, the elastomeric bodies are thicker parallel to the direction of impact of the hammer or drill than perpendicular to this direction. According to another advantageous embodiment, this can be achieved by providing the elastomeric bodies with an elliptical outer contour.

BRIEF DESCRIPTION OF THE DRAWINGS

The invention will now be explained in more detail with reference to the following description of an exemplary embodiment which is depicted in the drawing, in which.

DETAILED DESCRIPTION OF THE PREFERRED EMBODIMENT

Figure 1:
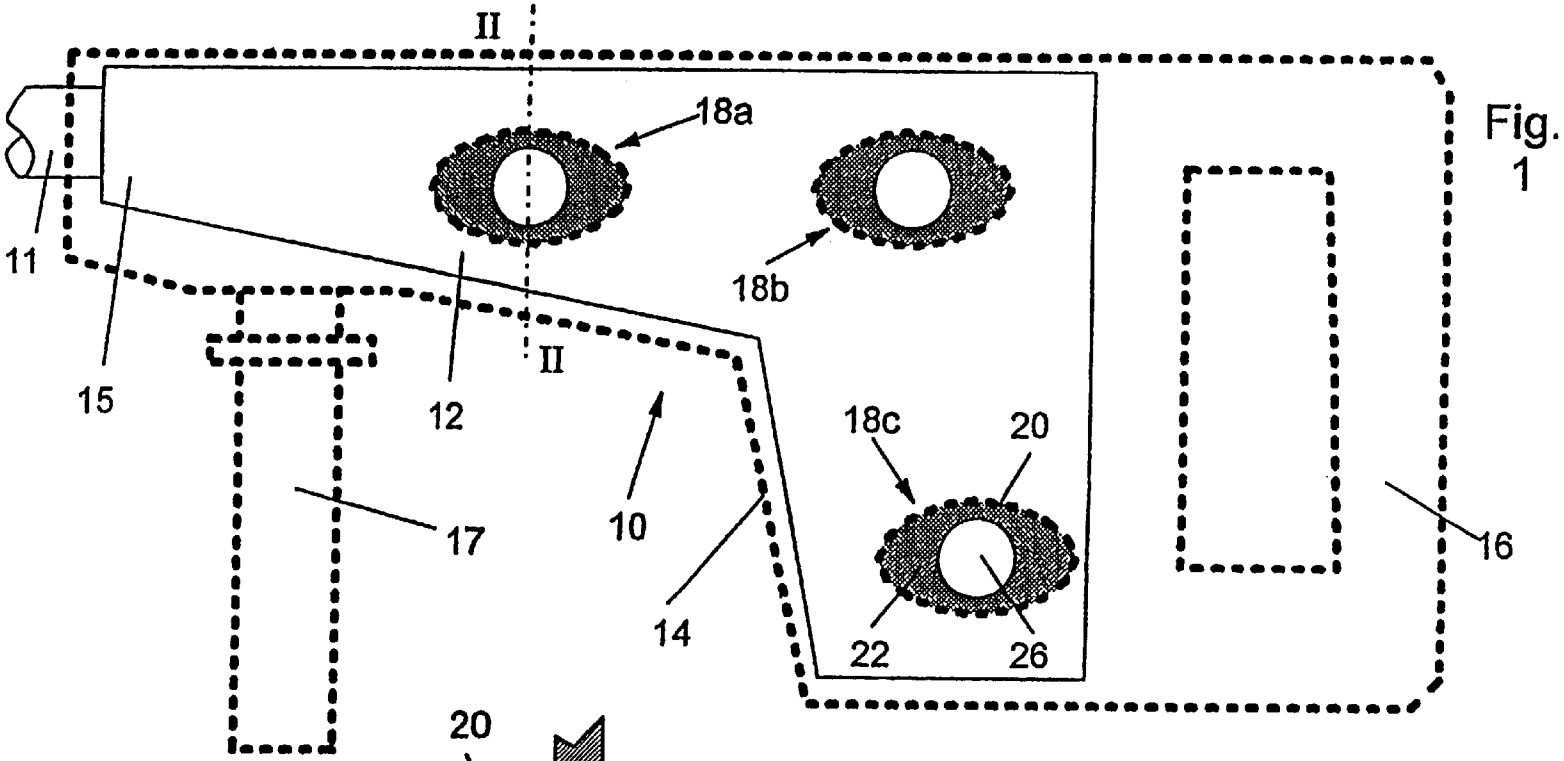
FIG. 1 shows a diagrammatic side view of a percussion hammer and/or hammer drill which is designed according to the invention.

A percussion hammer and/or hammer drill 10 essentially comprises two parts, namely a hammer casing 12, in which a holder which accommodates the percussion tool 11 and is not specifically shown and an associated vibration-exciting mechanism are accommodated, and an outer shell 14 which is made from plastic, surrounds the hammer casing 12 at a distance therefrom and is provided with an integrally molded handle 16. The outer shell 14 extends at least almost as far as that area 15 of the hammer casing 12 from which the percussion tool 11 projects. A second handle 17 is attached or integrally molded on this end, facing toward the percussion tool, of the outer shell 14.

Figure 2:
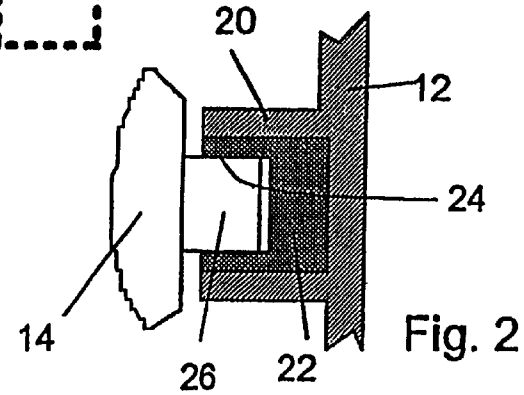
FIG. 2 shows a section through a coupling point on line II—II in FIG. 1.

In the example described, the connection between the hammer casing 12 and the outer shell 14 on both sides of the hammer casing 12 is formed at in each case three coupling points 18*a*, 18*b* and 18*c*, which do not lie on a straight line, in the manner explained below with reference to FIG. 2.

At each coupling point, an outwardly protruding, sleeve-like protrusion 20 is arranged on the hammer casing 12, which protrusion is suitable for surrounding a body 22 made from elastomeric material, which has a central hole 24 which runs at least substantially perpendicular to the longitudinal center plane of the hammer casing 12, which is parallel to the plane of the drawing in FIG. 1. A bolt 26 which projects inward from the inside of the outer shell 14 engages in this hole 24. As can be seen from FIG. 1, the contour of the protrusion 20 and of the body 22 is delimited by an ellipse, the long axis of which runs in the vibrating direction of the tool 11. Consequently, the resilience in this vibrating direction is softer than in the direction which is perpendicular to the vibrating direction and runs parallel to the said longitudinal center plane. It will be clear to the person skilled in the art that it is possible to achieve any desired changes to the resilience by selecting a suitable contour of the protrusion 20 and the body 22.

Depending on the particular embodiment, an arrangement in which the bolt 26 projects out from the hammer casing 12 and the sleeve 20 is provided on the outer shell 14 may also be advantageous.

What is claimed is:

1. A percussion hammer and/or hammer drill comprising a hammer casing which 1) surrounds a percussion mechanism together with a drive and a holder for a percussion tool and 2) is surrounded, at a distance, by an outer shell 1) which is connected to the hammer casing via elastomeric bodies which dampen vibrations both in a direction that is parallel to a direction of impact of the hammer or drill and in a direction that is perpendicular to the direction of impact of the hammer or drill, the elastomeric bodies having different resilient properties in the different directions, and 2) at whose end which is remote from the percussion tool in the direction of impact thereof there is a handle that projects from an area of the hammer casing, wherein the outer shell extends at least almost as far as the area of the hammer casing from which the percussion tool projects.

2. The hammer or drill as claimed in claim 1, wherein elastomeric bodies on two sides of the hammer casing are arranged symmetrically with respect to a longitudinal center plane of the hammer or drill.

3. The hammer or drill as claimed in claim 2, wherein the outer shell is connected to the hammer casing at two coupling points on each side of the hammer casing, and wherein a line of action of the percussion tool intersects a plane which includes the coupling points.

4. The hammer or drill as claimed in claim 1, wherein the outer shell is connected to the hammer casing at case three coupling points on each side of the hammer casing, which do not lie on a common straight line.

5. The hammer or drill as claimed in claim 1, wherein the elastomic bodies each have a hole which is at least substantially perpendicular to a longitudinal center plane of the hammer casing and in which a bolt, which projects inward from the outer shell, engages the hole.

6. The hammer or drill as claimed in claim 5, wherein the elastomeric bodies are each held in a sleeve on the hammer casing.

7. The hammer or drill as claimed in claim 1, wherein the outer shell is made from plastic.

8. The hammer or drill as claimed in claim 1, wherein the elastomeric bodies have different dimensions in two directions which intersect one another in an axis of the hole and are perpendicular to one another.

9. The hammer or drill as claimed in claim 8, wherein the elastomeric bodies are thicker parallel to the direction of impact of the hammer or drill than perpendicular to this direction.

10. The hammer or drill as claimed in claim 8, wherein the elastomeric bodies have an elliptical outer contour.

11. The hammer or drill as claimed in claim 1, further comprising a second handle which extends from the outer shell at an angle that is perpendicular to the first handle.

12. The hammer of drill as claimed in claim 1, wherein the elastomeric bodies are less resilient in the direction that is parallel to the direction of impact of the hammer or drill than in the direction which is perpendicular to the direction of impact.

13. A percussion tool assembly comprising:

a percussion mechanism;

a percussion tool driven by the percussion mechanism;

a holder for the percussion tool;

a hammer casing which surrounds the percussion mechanism and the holder;

an outer shell which 1) surrounds the hammer casing at a distance, and 2) is connected to the hammer casing via elastomeric bodies which dampen vibrations both in a first direction that is parallel to a direction of impact of the percussion mechanism and in a second direction that is perpendicular to the direction of impact of the percussion mechanism, the elastomeric bodies having different resilient properties in the first and second directions; and a handle which projects from an area of the hammer casing and which is located at an end of the outer shell which is remote from the percussion tool in the direction of impact thereof.

14. The percussion tool assembly as claimed in claim 13, wherein the elastomeric bodies are arranged symmetrically with respect to a longitudinal center plane of the hammer or drill.

15. The percussion tool assembly as claimed in claim 14, wherein the outer shell is connected to the hammer casing at two coupling points on each side of the hammer casing, and wherein a line of action of the percussion tool intersects a plane which includes the elastomeric bodies.

16. The percussion tool assembly as claimed in claim 13, wherein the outer shell is connected to the hammer casing at three coupling points on each side of the hammer casing, and wherein the coupling points on each side of the hammer casing do not lie on a common straight line.

17. The percussion tool assembly as claimed in claim 13, wherein the elastomeric bodies each have a hole which is at least substantially perpendicular to a longitudinal center plane of the hammer casing, and further comprising a plurality of bolts, each of which projects inwardly from the outer shell and which engages the hole in an associated elastomeric body.

18. The percussion tool assembly as claimed in claim 17, wherein the elastomeric bodies are less resilient in the first direction of impact of the hammer or drill than in the second direction.

19. The percussion tool assembly as claimed in claim 17, wherein the elastomeric bodies have different dimensions in the first and second directions.

20. The percussion tool assembly as claimed in claim 19, wherein the elastomeric bodies are thicker parallel to the first direction than in the second direction.

21. The percussion tool assembly as claimed in claim 19, wherein the elastomeric bodies have an elliptical outer contour.

22. The percussion tool assembly as claimed in claim 13, wherein the outer shell is made from a material comprising a plastic.

23. The percussion tool assembly as claimed in claim 22, wherein the elastomeric bodies are each held in a sleeve on the hammer casing.

24. The percussion tool assembly as claimed in claim 13, further comprising a second handle which extends laterally from the outer shell.

* * * * *